US005905065A

United States Patent [19]

Scialla et al.

[11] Patent Number: 5,905,065

[45] **Date of Patent: *May 18, 1999**

[54] CARPET CLEANING COMPOSITIONS AND METHOD FOR CLEANING CARPETS

[75] Inventors: Stefano Scialla; Floriana Raso, both of Rome, Italy

[73] Assignee: The Procter & Gamble Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 08/672,174

[22] Filed: Jun. 27, 1996

Related U.S. Application Data

[ 60] Provisional application No. 60/000,557, Jun. 27, 1995.

[30] Foreign Application Priority Data

Jun. 30, 1995 [EP] European Pat. Off. ..... 95870079

[51] Int. Cl.[6] ..... C11D 7/38

[52] U.S. Cl. ..... 510/280; 510/278; 510/370; 510/372; 8/137

[58] Field of Search ..... 510/108, 436, 510/109, 299, 278, 302, 280, 405, 433, 434, 303, 309, 318, 319, 321, 370, 337, 342, 350, 382, 383, 400, 528, 531, 533, 372; 8/137

[56] References Cited

U.S. PATENT DOCUMENTS

| | | | |
|---|---|---|---|
| 3,223,647 | 12/1965 | Drew et al. | 510/427 |
| 3,281,368 | 10/1966 | Zimmerer et al. | 510/433 |
| 3,308,067 | 3/1967 | Diehl . | |
| 3,607,760 | 9/1971 | McIntyre . | |
| 3,723,323 | 3/1973 | Morgan . | |
| 3,803,040 | 4/1974 | Gray | 510/227 |
| 3,812,044 | 5/1974 | Connor et al. | 510/477 |
| 4,110,262 | 8/1978 | Arnau et al. . | |
| 4,130,501 | 12/1978 | Lutz et al. . | |
| 4,259,201 | 3/1981 | Cockrell, Jr. et al. . | |
| 4,410,442 | 10/1983 | Lucas et al. | 510/112 |
| 4,496,473 | 1/1985 | Sanderson . | |
| 4,525,291 | 6/1985 | Smith et al. | 510/303 |
| 4,586,315 | 5/1986 | Wolf . | |
| 4,648,882 | 3/1987 | Osberghaus et al. | 8/142 |
| 4,652,389 | 3/1987 | Moll . | |
| 4,663,071 | 5/1987 | Bush et al. . | |
| 4,704,233 | 11/1987 | Hartman et al. . | |
| 4,775,424 | 10/1988 | Wisotzki et al. | 510/112 |
| 4,797,223 | 1/1989 | Amick et al. . | |
| 4,818,425 | 4/1989 | Meijer et al. . | |
| 4,820,450 | 4/1989 | Wile et al. . | |
| 4,830,997 | 5/1989 | Trinh et al. | 502/28 |
| 4,891,147 | 1/1990 | Gray et al. . | |
| 4,966,723 | 10/1990 | Hodge et al. . | |
| 5,019,289 | 5/1991 | Gray et al. . | |
| 5,130,053 | 7/1992 | Feasey et al. . | |
| 5,259,848 | 11/1993 | Terry et al. | 8/111 |
| 5,264,143 | 11/1993 | Boutique | 510/303 |
| 5,332,527 | 7/1994 | Heinzman et al. . | |
| 5,364,549 | 11/1994 | McDonogh . | |
| 5,395,555 | 3/1995 | Colurciello et al. . | |
| 5,503,639 | 4/1996 | Willey et al. | 8/111 |
| 5,700,771 | 12/1997 | Hardy et al. | 510/315 |
| 5,703,031 | 12/1997 | Trani et al. | 510/312 |
| 5,716,923 | 2/1998 | MacBeath | 510/313 |
| 5,759,439 | 6/1998 | Kott et al. . | |

FOREIGN PATENT DOCUMENTS

| | | |
|---|---|---|
| 0 001 310 | 4/1979 | European Pat. Off. . |
| 013 886 | 8/1980 | European Pat. Off. . |
| 0 066 915 A2 | 12/1982 | European Pat. Off. . |
| 066 915 | 12/1982 | European Pat. Off. . |
| 144166 | 6/1985 | European Pat. Off. . |
| 209 228 | 1/1987 | European Pat. Off. . |
| 0 346 835 B1 | 12/1989 | European Pat. Off. . |
| 346835 | 12/1989 | European Pat. Off. . |
| 351 772 | 1/1990 | European Pat. Off. . |
| 0 629 694 A1 | 12/1994 | European Pat. Off. . |
| 629 690 | 12/1994 | European Pat. Off. . |
| 629 691 | 12/1994 | European Pat. Off. . |
| 629 694 | 12/1994 | European Pat. Off. . |
| 3430773 | 3/1985 | Germany . |
| 6-17092 | 1/1994 | Japan . |
| 8-27484 | 1/1996 | Japan . |
| 1 234 320 | 6/1971 | United Kingdom . |
| 1 586 769 | 3/1981 | United Kingdom . |
| 2 227 021 | 7/1990 | United Kingdom . |
| 92/17634 | 10/1992 | WIPO . |
| 93/12067 | 6/1993 | WIPO . |
| 94/03553 | 2/1994 | WIPO . |
| 94/09103 | 4/1994 | WIPO . |
| 94/11099 | 5/1994 | WIPO . |
| 96/15308 | 5/1996 | WIPO . |

OTHER PUBLICATIONS

Derwent Abstract No. 93–345671/44 for DE 4213036, Oct. 1993.

*Primary Examiner*—Alan Diamond
*Attorney, Agent, or Firm*—Robert B. Aylor

[57] ABSTRACT

The present invention relates to compositions comprising from 0.01% to 10% by weight of the total composition of salicylic acid or derivatives thereof according to the following formula:

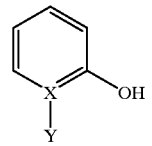

wherein X is carbon, Y is one of the following groups —CHO, —OH, —(CH2)n—COOH, wherein n is an integer of from 0 to 20 and from 0.01% to 20% by weight of a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N-oxides and derivatives thereof, chelating agents, and mixtures thereof. Said compositions are particularly suitable for the cleaning of carpets, resulting in improved particulate stains and/or greasy/oily stains removal performance.

15 Claims, No Drawings

CARPET CLEANING COMPOSITIONS AND METHOD FOR CLEANING CARPETS

This application claims the benefit of provisional application Ser. No. 60/000,557 filed Jun. 27, 1995.

TECHNICAL FIELD

The present invention relates to cleaning compositions and more particularly to cleaning compositions having the ability to remove stains, soils or combinations thereof from carpets.

BACKGROUND OF THE INVENTION

Carpets produced from synthetic or natural fibers and mixtures thereof are commonly used in residential and commercial applications as a floor covering. Various types of fibers can be used in making carpets such as polyamide fibers, polyester fibers as well as wool, cotton or even silk in the case of rugs.

However, carpets, irrespective of whether they are made from natural or synthetic fibers, are all prone to soiling and staining when contacted with many household items. Foods, grease, oils, beverages in particular such as coffee, tea and soft drinks especially those containing acidic dyes can cause unsightly, often dark stains on carpets. Also fibers may become soiled as a result of dirt particles, clay, dust, particulate soils in general, coming into contact with and adhering to the fibers of the carpet. These latter soils often appear in the form of a diffuse layer of soils rather than in the form of spots and tend to accumulate particularly in the so called "high traffic areas" such as near doors as a result of intensive use of the carpets in such areas.

There are a number of carpet cleaning compositions described in the art for removing stains and soils. However, these compositions do not satisfactorily meet the consumer's needs regarding their stain removal performance on different types of stains and soils. Indeed, these carpet cleaning compositions are not fully satisfactory on removing particulate stains and/or greasy stains, especially in the so called "high traffic areas".

Thus, the object of the present invention is to provide improved stains removal from carpets, in a manner which is applicable to a variety of carpet cleaning compositions, i.e. compositions being either in a liquid form or in a powder form or in a granular form.

It has now been found that the above object can be met by formulating compositions which comprise a salicylic acid or derivatives thereof according to the following formula:

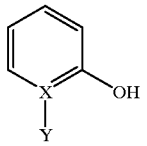

wherein X is carbon, Y is one of the following groups —CHO, —OH, —(CH2)n—COOH and wherein n is an integer of from 0 to 20 and a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N oxides and derivatives thereof chelating agents, and mixtures thereof. Indeed, such a composition allows to obtain excellent particulate stains removal performance especially on diffuse layers of stains and/or soils which occur in the so called "high traffic areas", i.e. on stains and/or soils which have become otherwise extremely difficult to remove. More particularly, it has been found that the combination of salicylic acid or derivatives thereof or mixtures thereof with a compound selected from the group consisting of amine oxide surfactants, soil suspending polycarboxylate polymers, soil suspending polyamine polymers, hydroxy-pyridine-N-oxides and derivatives thereof, chelating agents, and mixtures thereof, results in a synergistic effect on the removal of particulate stains and/or greasy stains from carpets. Furthermore, said combination is particularly suitable to be used in liquid carpet cleaning compositions which further comprise a source of active oxygen, thereby providing not only improved particulate and/or greasy stains removal performance but also improved stains removal on bleachable stains, as compared to the same compositions without said salicylic acid or derivatives thereof, or to the same compositions without said compound selected from the group consisting of amine oxide surfactants, soil suspending polycarboxylate polymers, soil suspending polyamine polymers, hydroxy-pyridine-N-oxides and derivatives thereof, chelating agents, and mixtures thereof.

An advantage of the present invention is that it is applicable to all carpet types, especially delicate natural fibers and is also safe to all carpet dye types, particularly sensitive natural dyes used therein. The compositions of the present invention are also suitable to be used to clean upholstery and car seats covering.

Another advantage of the compositions of the present invention is that they may be applied directly on the carpet without causing damage to the carpet. In addition the cleaning action of the invention commences as soon as the carpet cleaning composition has been applied to the surface. Indeed, the use of the carpet cleaning compositions of the present invention does not necessarily require rubbing or/and brushing of the carpet.

The following documents are representative of the prior art available on carpet cleaning compositions.

WO 92/17634 discloses a method for removing stains from carpet fibers which consists of applying an alkaline solution (pH=7 to 10.5) to said carpet, said solution resulting from mixing just prior use of a solution of a source of active oxygen with a solution of ammonium bicarbonate or carbonate and fluorinated alkyl sulfonic acid or its coordinated salt. This patent application nowhere mentions salicylic acid or derivatives thereof, soil suspending polycarboxylate or polyamine polymers, hydroxy pyridine N oxide, or amine oxide surfactants.

U.S. Pat. No. 3,607,760 discloses an aqueous carpet cleaner particularly suitable for removing pet stains, said carpet cleaner comprising hydrogen peroxide, hydrocarbon ether of ethylene or diethylene glycols, hydrocarbon monohydric alcohols and EDTA. No salicylic acid or derivatives thereof are disclosed.

EP-A-346 835 discloses an aqueous carpet cleaner at pH 7–12 comprising a water-soluble alcohol (C1–C5) and an oxidizing agent (hydrogen peroxide). No salicylic acid or derivatives thereof are described.

EP-A-629 694 discloses the use of stable aqueous compositions comprising a source of active oxygen, having a pH of from 1 to 6, for the cleaning of carpets. No salicylic acid or derivatives thereof are disclosed.

PCT patent application number US95/13995 discloses a method of cleaning a carpet wherein a composition comprising a chelating agent in combination with a soil suspending polycarboxylate or polyamine polymer is applied to said carpet. Salicylic acid or derivatives thereof are not disclosed therein.

SUMMARY OF THE INVENTION

The present invention encompasses a composition comprising from 0.01% to 10% by weight of the total composition of salicylic acid or derivatives thereof according to the following formula:

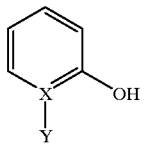

wherein X is carbon, Y is one of the following groups —CHO, —OH, —(CH2)n—COOH and wherein n is an integer of from 0 to 20, and from 0.01% to 20% by weight of a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N-oxides and derivatives thereof, chelating agents, and mixtures thereof.

The present invention further encompasses a method of cleaning a carpet wherein a composition comprising said salicylic acid or derivatives thereof in combination with a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N-oxides and derivatives thereof, chelating agents, and mixtures thereof, is applied to said carpet, wherein said carpet is then optionally rubbed and/or brushed, and wherein said composition is then removed from said carpet.

The present invention also encompasses the use of a composition comprising said salicylic acid or derivatives thereof in combination with a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N-oxides and derivatives thereof, chelating agents, or mixtures thereof, for the cleaning of carpets, to provide improved particulate stains and/or greasy stains removal performance.

All amounts, percentages and ratios are given by weight of the total composition in its neat form unless otherwise stated.

DETAILED DESCRIPTION OF THE INVENTION

The compositions according to the present invention may be formulated either as solids or liquids. In the case where the compositions are formulated as solids for example as granular compositions or powder compositions, they may be applied directly on the carpet to be treated or they may be diluted with an appropriate solvent, typically water, before use. In liquid form, the compositions are preferably but not necessarily formulated as aqueous compositions. Liquid compositions are preferred herein for convenience of use.

As a first essential ingredient, the compositions of the present invention comprise salicylic acid or derivatives thereof, or mixtures thereof according to the following formula:

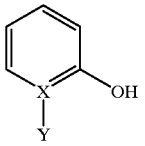

wherein X is carbon, Y is one of the following groups —CHO, —OH, —(CH2)n—COOH, and preferably is —(CH2)n—COOH, and wherein n is an integer of from 0 to 20, preferably of from 0 to 10 and more preferably is 0. Salicylic acid and derivatives thereof may be used herein either in their acid form or in their salts form as for example sodium salts.

Salicylic acid is particularly preferred herein and may be commercially available from Rhone Poulenc.

The compositions of the present invention comprise from 0.01% to 10% by weight of the total composition of said salicylic acid or derivatives thereof or mixtures thereof, preferably from 0.01% to 5%, more preferably from 0.05% to 3%, and most preferably from 0.08% to 1%.

As a second essential ingredient, the compositions of the present invention comprise a compound selected from the group consisting of amine oxide surfactants according to the formula R1R2R3NO, wherein each of R1, R2 and R3 is independently a saturated substituted or unsubstituted, linear or branched alkyl groups of from 1 to 30 carbon atoms, soil suspending polycarboxylate polymers, soil suspending polyamine polymers, hydroxy-pyridine N-oxides and derivatives thereof, chelating agents, and mixtures thereof.

Suitable amine oxide surfactants to be used herein are according to the following formula $R_1R_2R_3NO$ wherein each of R1, R2 and R3 is independently a saturated substituted or unsubstituted, linear or branched alkyl groups of from 1 to 30 carbon atoms, preferably of from 1 to 20 carbon atoms. Particularly preferred amine oxide surfactants to be used according to the present invention are amine oxide surfactants having the following formula $R_1R_2R_3NO$ wherein R1 is a saturated linear or branched alkyl group of from 1 to 30 carbon atoms, preferably of from 6 to 20 carbon atoms, more preferably of from 6 to 16 carbon atoms, and wherein R2 and R3 are independently substituted or unsubstituted, linear or branched alkyl groups of from 1 to 4 carbon atoms, preferably of from 1 to 3 carbon atoms, and more preferably are methyl groups. In the preferred embodiment of the present invention said amine oxide surfactants used herein are pure-cut amine oxide surfactants, i.e., a pure single amine oxide surfactant, e.g. $C_8$ N,N-dimethyl amine oxide, as opposed to mixtures of amine oxide surfactants of different chain lengths.

Suitable amine oxide surfactants for use herein are for instance pure cut C8 amine oxide, pure cut C10 amine oxide, pure cut C14 amine oxide, natural blend C8–C10 amine oxides as well as natural blend C12–C16 amine oxides. Such amine oxide surfactants may be commercially available from Hoechst or Stephan.

Said amine oxide surfactants are preferred herein as said second essential ingredient. Said amine oxide surfactants besides the outstanding stain removal performance they provide on various types of stains, further provide other advantages. Indeed, in the preferred embodiment of the present invention wherein the compositions herein further comprise a source of active oxygen, the presence of said amine oxide surfactants contributes to improve the chemical stability of said compositions. It is believed that improved chemical stability associated to the use of said amine oxide surfactants in bleaching compositions is due to the capacity of said amine oxide surfactants to lower the decomposition of said source of active oxygen and/or to limit interactions between said source of active oxygen and a bleach activator, if present, possibly through emulsification. It is believed that this stabilising effect is matrix independent.

Furthermore, amine oxide surfactants, especially pure-cut amine oxide surfactants, have the advantage to reduce the amount of residues left onto carpet fibers being treated with a composition comprising them. Also, the residues left after said composition comprising them has performed its cleaning action onto said carpet fibers are partially in a crystalline form. Indeed, it has been observed that with the compositions of the present invention which comprise said amine oxide surfactants, and especially a pure-cut amine oxide surfactant, more than 90%, preferably more than 95%, of the residues left onto the carpet fibers are crystals (generally lamellar and/or needle-shaped) with an average particle surface bigger than 300 $\mu^2$. This results in a process of cleaning carpets whereby the residues left onto the carpets are removed more easily as opposed to residues being sticky and thus difficult to remove by for example vacuum cleaning said carpets.

Another advantage of the presence of said amine oxide surfactants, for example of mixtures of short chain amine oxide surfactants (C6–C10) with longer chain ones (e.g., C12–C30 amine oxide surfactants), in the compositions according to the present invention, is that they allow to control the foam level and especially the foam persistence in said compositions. This results in compositions being particularly suitable to be used in carpet cleaning machines as well as neat onto carpets without formation of high amounts of foam.

Any soil suspending polycarboxylate polymer known to those skilled in the art can be used according to the present invention such as homo- or co-polymeric polycarboxylic acids or their salts including polyacrylates and copolymers of maleic anhydride or/and acrylic acid and the like. Indeed, such soil suspending polycarboxylate polymers can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates to be used herein can be derived from acrylic acid. Such acrylic acid-based polymers which are useful herein are the water-soluble salts of polymerized acrylic acid. The average molecular weight of such polymers in the acid form preferably ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967.

Acrylic/maleic-based copolymers may also be used as a preferred soil suspending polycarboxylic polymer. Such materials include the water-soluble salts of copolymers of acrylic acid and maleic acid. The average molecular weight of such copolymers in the acid form preferably ranges from about 2,000 to 100,000, more preferably from about 5,000 to 75,000, most preferably from about 7,000 to 65,000. The ratio of acrylate to maleate segments in such copolymers will generally range from about 30:1 to about 1:1, more preferably from about 10:1 to 2:1. Water-soluble salts of such acrylic acid/maleic acid copolymers can include, for example, the alkali metal, ammonium and substituted ammonium salts. Soluble acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5.

Any soil suspending polyamine polymer known to those skilled in the art may also be used herein. Particularly suitable polyamine polymers for use herein are polyalkoxylated polyamines. Such materials can conveniently be represented as molecules of the empirical structures with repeating units:

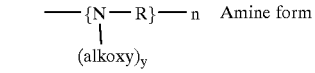

Amine form and

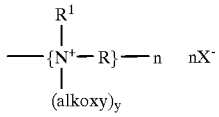

nX⁻ Quarternized form wherein R is a hydrocarbyl group, usually of 2–6 carbon atoms; $R^1$ may be a $C_1$–$C_{20}$ hydrocarbon; the alkoxy groups are ethoxy, propoxy, and the like, and y is 2–30, most preferably from 10–20; n is an integer of at least 2, preferably from 2–20, most preferably 3–5; and $X^-$ is an anion such as halide or methylsulfate, resulting from the quatemization reaction.

The most highly preferred polyamines for use herein are the so-called ethoxylated polyethylene amines, i.e., the polymerized reaction product of ethylene oxide with ethyleneimine, having the general formula:

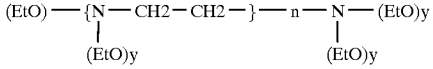

when y=2–30. Particularly preferred for use herein is an ethoxylated polyethylene amine, in particular ethoxylated tetraethylenepentamine, and quaternized ethoxylated hexamethylene diamine.

Suitable hydroxy pyridine N-oxides and derivatives thereof to be used according to the present invention are according to the following formula:

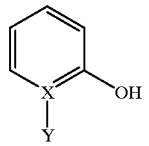

wherein X is nitrogen, Y is one of the following groups oxygen, —CHO, —OH, —(CH2)n—COOH, wherein n is an integer of from 0 to 20, preferably of from 0 to 10 and more preferably is 0, and wherein Y is preferably oxygen. Accordingly, particularly preferred hydroxy pyridine N-oxides and derivatives thereof to be used herein is 2-hydroxy pyridine N-oxide.

Hydroxy pyridine N-oxides and derivatives thereof may be commercially available from Sigma.

Suitable chelating agents to be used according to the present invention include any chelating agent known to those skilled in the art. Suitable chelating agents include for example phosphonate chelating agents, polyfunctionally-substituted aromatic chelating agents, amino carboxylate chelating agents, other chelating agents like ethylene diamine N,N'-disuccinic acid and mixtures thereof.

Suitable phosphonate chelating agents to be used herein may include ethydronic acid, alkali metal ethane 1-hydroxy diphosphonates as well as amino phosphonate compounds, including amino alkylene poly (alkylene phosphonate), alkali metal ethane 1-hydroxy diphosphonates, nitrilo trimethylene phosphonates, ethylene diamine tetra methylene phosphonates, and diethylene triamine penta methylene phosphonates. The phosphonate compounds may be present either in their acid form or as salts of different cations on some or all of their acid functionalities. Preferred phosphonate chelating agents to be used herein are diethylene triamine penta methylene phosphonates (DETPMP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987. to Hartman and Perkins. Ethylenediamine N,N'-disuccinic acids are, for instance, commercially available under the tradename ssEDDS® from Palmer Research Laboratories.

Suitable amino carboxylate chelants to be used herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexa-acetates, ethanoldiglycines, propylene diamine tetracetic acid (PDTA) and methyl glycine diacetic acid (MGDA), both in their acid form, or in their alkali metal, ammonium, and substituted ammonium salt forms. Particularly suitable amino carboxylate to be used herein is diethylene triamine penta acetic acid (DTPA).

Preferred second essential ingredients to be used in the compositions of the present invention are said amine oxide surfactants and/or said polycarboxylate and/or polyamine polymers.

The compositions according to the present invention comprise from 0.01% to 20% by weight of the total composition of said compound selected from the group consisting of said amine oxide surfactants, said soil suspending polycarboxylate polymers, said soil suspending polyamine polymers, hydroxy pyridine-N-oxides and derivatives thereof, chelating agents, and mixtures thereof, preferably from 0.05% to 15%, more preferably from 0.1% to 10% and most preferably from 0.5% to 7%.

The concentrations mentioned herein for salicylic acid or derivatives thereof and the compound selected from the group consisting of said amine oxide surfactants, said soil suspending polycarboxylic and polyamine polymers, said chelating agents, hydroxy pyridine N-oxides and derivatives thereof, and mixtures thereof, are preferred in that, at these concentrations, maximum performance is obtained in the most economic way. Also, at these concentrations the amount of residues that the compositions may leave on carpets is minimal.

The compositions of the present invention allow to provide improved particulate and/or greasy/oily stains removal performance when used to clean carpets.

By "improved particulate and/or greasy/oily stains removal performance" it is meant herein that the removal of particulate stains and/or greasy/oily stains from carpets achieved by using a carpet cleaning composition comprising salicylic acid or derivatives thereof with a compound selected from the group consisting of said amine oxide surfactants, said soil suspending polycarboxylic polymers, said soil suspending polyamine polymers, said chelating agents, hydroxy pyridine-N-oxides and derivatives thereof, and mixtures thereof, is improved, as compared to the removal of particulate stains and/or greasy/oily stains obtained by using the same composition without said salicylic acid or derivatives thereof or the same composition without any compound selected from the group consisting of said amine oxide surfactants, said soil suspending polycarboxylic polymers, said soil suspending polyamine polymers, said chelating agents, hydroxy pyridine-N-oxides and derivatives thereof and mixtures thereof. More particularly, it has been unexpectedly found that a synergistic effect on particulate stains and/or greasy/oily stains removal performance is associated to the use of a composition comprising said salicylic acid or derivatives thereof in combination with said compound selected from the group consisting of said amine oxide surfactants, said soil suspending polycarboxylic and polyamine polymers, said chelating agents, hydroxy pyridine N-oxides and derivatives thereof, and mixtures thereof.

By "particulate stains" it is meant herein any soils or stains of particulate nature that can be found on any carpet, e.g. clay, dirt, dust, mud, concrete and the like.

By "greasy/oily stains" it is meant herein any soils or stains of greasy/oily nature that can be found on any carpet, e.g., make-up, lipstick, dirty motor oil and mineral oil, greasy food like mayonnaise and spaghetti sauce.

It has further been found that the combination of the present invention, i.e., said salicylic acid or derivatives thereof with said second essential compound as mentioned herein, is particularly suitable to be used in a carpet cleaning composition which further comprises a source of active oxygen, thereby providing not only improved particulate and/or greasy stains removal performance but also improved stains removal on bleachable stains, as compared to the same composition without said salicylic acid or derivatives thereof, or to the same composition without said compound selected from the group consisting of amine oxide surfactants, soil suspending polycarboxylate polymers, soil suspending polyamine polymers, hydroxy-pyridine-N-oxides and derivatives thereof, chelating agents, and mixtures thereof.

The compositions of the present invention may further comprise as an optional but highly preferred ingredient a source of active oxygen or mixtures thereof. Said preferred compositions for the cleaning of carpets according to the present invention are particularly efficient in cleaning diffuse soils (particulate and/or greasy soils) that tend to accumulate in the so called "high traffic areas" but also in delivering good cleaning performance on other types of stains or soils, i.e. on spot stains, bleachable stains such as coffee, beverage, food and the like and enzymatic stains like blood.

Also, an advantage associated with the compositions herein comprising a source of active oxygen and being formulated as liquid aqueous compositions, is that said compositions are chemically stable. Accordingly, said compositions are convenient for the consumer to use. Indeed, said liquid aqueous compositions for the cleaning of carpets according to the present invention do not require pH adjustment prior to use and can be stored for long periods of time prior to use.

A preferred source of active oxygen according to the present invention is hydrogen peroxide or sources thereof. As used herein a hydrogen peroxide source refers to any compound which produces hydrogen peroxide when said compound is in contact with water. Suitable water-soluble sources of hydrogen peroxide for use herein include percarbonates, metal peroxides and perborates.

In addition, other classes of peroxides can be used as an alternative to hydrogen peroxide and sources thereof or in combination with hydrogen peroxide and sources thereof. Suitable classes include dialkylperoxides, diacylperoxides, preformed percarboxylic acids, persilicates, persulphates, organic and inorganic peroxides and/or hydroperoxides.

Suitable organic and inorganic peroxides/hydroperoxides for use in the compositions according to the present invention include diacyl and dialkyl peroxides/hydroperoxides such as dibenzoyl peroxide, t-butyl hydroperoxide, dilauroyl peroxide, dicumyl peroxide, persulphuric acid and mixtures thereof.

Suitable preformed peroxyacids for use in the compositions for the cleaning of carpets according to the present invention include diperoxydodecandioic acid DPDA, magnesium perphthalatic acid, perlauric acid, perbenzoic acid, diperoxyazelaic acid and mixtures thereof.

Accordingly, the compositions according to the present invention comprise from 0.1% to 15%, preferably from 0.5% to 10%, more preferably from 1% to 7% by weight of active oxygen in said compositions.

As used herein, active oxygen concentration refers to the percentage concentration of elemental oxygen, with an oxidation number zero, that being reduced to water would be stoichiometrically equivalent to a given percentage concentration of a given peroxide compound, when the peroxide functionality of the peroxide compound is completely reduced to oxides. The active oxygen sources according to the present invention increase the ability of the compositions to remove colored stains, to destroy malodorous molecules and to kill germs.

The concentration of available oxygen can be determined by methods known in the art, such as the iodimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

The compositions according to the present invention may further comprise a bleach activator or mixtures thereof, as another optional ingredient. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactam selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmentally friendly as it eventually degrades into citric acid and alcohol. Furthermore, acetyl triethyl citrate has a good hydrolytical stability in the composition upon storage and it is an efficient bleach activator.

The compositions according to the present invention may comprise up to 30% by weight of the total composition of said bleach activator, or mixtures thereof, preferably from 1% to 20%, and more preferably from 2% to 10%.

The pH of the liquid compositions according to the present invention can be from 1 to 14. In a preferred embodiment, wherein the liquid compositions herein comprise a source of active oxygen, the recommended pH range to achieve good hydrogen peroxide stability is from 1 to 9, preferably between pH 1 and 8, more preferably between pH 1 and 7 and most preferably between 2 and 6. Accordingly, the compositions herein may further comprise an acid to adjust pH. In addition, some acids can have the advantage that they can form small concentrations of the corresponding peracids by reaction with hydrogen peroxide in-situ, thus enhancing the overall performance of the composition. These acids can be further selected so as to have chelating and/or building properties. The acids of the present invention that may be used for these purposes can be organic or inorganic acids, preferably organic acids such as citric, maleic, oxalic succinic, and tartaric acids or inorganic acids such as sulphuric acid.

The compositions herein may further comprise a number of additional compounds such as surfactants, builder system, solvents, perfumes, dyes, suds suppressing agents, enzymes, photobleaching agents, and other minors. In the preferred embodiment, where the compositions herein comprise a source of active oxygen, the optional ingredients are selected so that they are compatible with said source of active oxygen.

The compositions of the present invention may further comprise a solvent or mixtures thereof. Solvents suitable for use herein may be octyl alcohol, isopropyl alcohol, propyl alcohol, ethoxypropoxy alcohol, buthoxypropoxy alcohol and/or furfuryl alcohol.

Pyrocatechol is a highly preferred optional ingredient to be used in the liquid compositions according to the present invention. The liquid compositions according to the present invention comprise up to 5% by weight of the total composition of pyrocatechol, preferably from 0.01% to 1% and more preferably from 0.01% to 0.5%.

Pyrocatechol improves the chemical stability of the liquid compositions of the present invention that further comprise a source of active oxygen, i.e. lower the decomposition of the bleach and the bleach activator if present. Indeed, it is believed that the chemical stabilising effect of pyrocatechol is twofold. Firstly they may work as radical scavengers and secondly they may interact with the hydrogen peroxide preventing or limiting hydrolysis, therefore reducing the rate of peroxide decomposition.

Surfactants may also be used in the compositions of the present invention. Surfactants for use herein are well known in the art and include anionic, nonionic, zwitterionic and cationic surfactants and mixtures thereof. The surfactants suitable for use herein are compatible with hydrogen peroxide and sources thereof.

The anionic surfactants which may be used herein include alkali metal salts of alkyl substituted benzene sulphonates, alkali metal alkyl sulphonates, alkali metal alkyl sulphates and alkali metal alkyl ether sulphates derived from for example fatty alcohols and alkyl phenols, alkali metal alkane sulphonates, alkali metal olefin sulphonates and alkali metal sulphosuccinates and alkyl succinates, whereby the sodium salts are preferred, alkyl carboxylates and alkyl ether carboxylates.

The nonionic surfactants which may be used herein include any liquid or solid ethoxylated $C_6$–$C_{24}$ fatty alcohol nonionic surfactant, alkyl propoxylates and mixtures thereof, fatty acid $C_6$–$C_{24}$ alkanolamides, $C_6$–$C_{20}$ polyethylglycol ethers, polyethylene glycol with molecular weight 1000 to 80000 and glucose amides, alkyl pyrrolidones, betaines.

Suitable cationic surfactants for use herein include quaternary ammonium compounds of the formula $R_1R_2R_3R_4N^+$ where $R_1$, $R_2$ and $R_3$ are methyl groups, and $R_4$ is a $C_{12-15}$ alkyl group, or where $R_1$ is an ethyl or hydroxy ethyl group, $R_2$ and $R_3$ are methyl groups and $R_4$ is a $C_{12-15}$ alkyl group.

Zwitterionic surfactants are also suitable optional ingredients for use herein. Suitable zwitterionic surfactants include derivatives of aliphatic quaternary ammonium, phosphonium, and sulphonium compounds in which the aliphatic moiety can be straight or branched chain and wherein one of the aliphatic substituents contains from about 8 to about 24 carbon atoms and another substituent contains, at least, an anionic water-solubilizing group. Particularly preferred zwitterionic materials are the ethoxylated ammonium sulphonates and sulfates disclosed in U.S. Pat. Nos. 3,925,262, Laughlin et al., issued Dec. 9, 1975 and 3,929,678, Laughlin et al., issued Dec. 30, 1975. The compositions herein comprise up to 70% by weight, preferably from 0. 1% to 50% by weight of the total composition of a surfactant or mixtures thereof.

The compositions according to the present invention may further comprise a builder system. Any conventional builder system is suitable for use herein. Suitable builders for use herein include citric acid, preferably in the form of a water-soluble salt, derivatives of succinic acid of the formula R—CH(COOH)$CH_2$(COOH) wherein R is $C_{10-20}$ alkyl or alkenyl, preferably $C_{12-16}$, or wherein R can be substituted with hydroxyl, sulpho sulphoxyl or sulphone substituents. Specific examples include lauryl succinate, myristyl succinate, palmityl succinate, 2-dodecenylsuccinate, 2-tetradecenyl succinate. Succinate builders are preferably used in the form of their water-soluble salts, including sodium, potassium, ammonium and alkanolammonium salts.

Other suitable builders are oxodisuccinates and mixtures of tartrate monosuccinic and tartrate disuccinic acid such as described in U.S. Pat. No. 4,663,071.

Further suitable builders for use herein are fatty acid builders including saturated or unsaturated $C_{10-18}$ fatty acids, as well as the corresponding soaps. Preferred saturated species have from 12 to 16 carbon atoms in the alkyl chain. The preferred unsaturated fatty acid is oleic acid.

A preferred builder system for use herein consists of a mixture of citric acid, fatty acids and succinic acid derivatives described herein above. The compositions herein may comprise from 0% to 10%, preferably from 1% to 7% by weight of the total composition of a builder system.

The present invention also encompasses a method of cleaning a carpet wherein a composition comprising said salicylic acid or derivatives thereof in combination with a compound selected from the group consisting of amine oxide surfactants according to the formula R1R2R3NO, wherein each of R1, R2 and R3 is independently a saturated substituted or unsubstituted, linear or branched alkyl group of from 1 to 30 carbon atoms, soil suspending polycarboxylate polymers, soil suspending polyamine polymers, hydroxy-pyridine N-oxides and derivatives thereof, chelating agents, and mixtures thereof, is applied to said carpet, wherein said carpet is then optionally rubbed and/or brushed, and wherein said composition is then removed from said carpet.

Indeed, in the method of cleaning a carpet according to the present invention the step of applying a composition for the cleaning of carpets as described herein before, may be followed by a rubbing step or/and a brushing step. An advantage of the present invention is that the cleaning action of the present compositions commence as soon as said compositions are applied onto said carpet. Thus the cleaning process of the present invention does not necessarily require rubbing and/or brushing. It is only in the case of highly soiled carpets or in the so called "high traffic areas" that the carpet may be cleaned by applying onto it a composition for the cleaning of carpets according to the present invention, then rubbing and/or brushing it more or less intensively for example by means of a sponge or a brush or other mechanical/electrical device, optionally with the aid of water. In general the rubbing/brushing-times are between 0.1 to a few minutes per square meters. After the composition for the cleaning of carpets according to the present invention has been applied onto the carpet and optionally rubbed and/or brushed, that said composition is removed from said carpet, preferably by mechanical means including brushing out and/or vacuum cleaning.

The compositions for the cleaning of carpets according to the present invention may be applied to the carpet to be cleaned either in neat or diluted form, this applies to compositions being either liquid compositions or granular compositions or powder compositions.

By "diluted form" it is meant herein that the compositions for the cleaning of carpets as described herein before may be diluted by the user, preferably with water. Compositions herein can be diluted up to 150 times, preferably up to 50 times and more preferably up to 25 times.

In a preferred embodiment herein, the compositions for the cleaning of carpets according to the present invention are liquid aqueous compositions. Indeed, a liquid aqueous composition, i.e. an aqueous composition for the cleaning of carpets as described herein before in its neat form or which has been diluted with water by the user or an aqueous composition resulting from the dilution of a granular composition or of a powder composition, is applied to the carpet to be cleaned, said carpet is optionally rubbed and/or brushed, then said composition is left to dry and then removed from said carpet. Indeed, said liquid aqueous composition is left to dry until said composition which combined with dirt has been changed into dry residues. These residues are then removed from the carpet mechanically. Such liquid aqueous compositions may be applied directly onto the area to be treated or applied using a cloth or piece of material such as spraying device or aerosol can, a sponge, a brush or other mechanical/electrical device. In a preferred embodiment of the invention a liquid aqueous composition is applied to the area to be treated by using a spraying device or an aerosol can. Such a spraying device may be trigger operated or pump operated or electrically operated or operated by any source of pressurised gas such as a can or a pressurizer. Such spraying devices are particularly preferable if a large area is to be treated as it facilitates the ease of use for the consumer. The spraying devices ensure uniform coverage of the area to be treated and maximises the advantage of the using liquid aqueous compositions containing peroxides. This is because the application of product by spray best allows the product to be left to dry on the area treated, even without rubbing or brushing. This optimises the action time of the composition and allows the best exploitation of the bleaching action of peroxides.

In another embodiment, the compositions for the cleaning of carpets according to the present invention are granular compositions or powder compositions. Such compositions for the cleaning of carpets according to the present invention may be applied directly onto the area of the carpet to be treated by for example sprinkling said composition over said area or may be applied by using a sponge, a brush, or other mechanical/electrical device preferably in presence of water and then left to dry and then removed from said carpet.

The area to be treated using the compositions according to the present invention may be any size. In addition, a complete section or even a whole carpet may be applied with the composition for the cleaning of carpets according to the present invention. For such purposes when using a liquid aqueous composition a spraying device with a pump to allow prolonged spraying is particularly useful.

The amount of the compositions for the cleaning of carpets according to the present invention applied will depend on the severity of the stain or soil. In the case of stubborn stains more than one application may be required to ensure complete removal of the stain. Indeed, the carpet cleaning compositions herein are particularly suitable to remove the dinginess of the carpets resulting from a diffused layer of soil which results from general wear.

The compositions for the cleaning of carpets according to the present invention may be used both for manual carpet cleaning and carpet cleaning machines. For carpet cleaning machines the compositions for the cleaning of carpets according to the present invention, i.e. either liquid compositions or granular compositions or powder compositions, may be preferably diluted according to the machine operating instructions. Furthermore, compositions to be used in such machines are formulated to prevent high sudsing.

According to the present invention the compositions herein may be used for the removal of stains and soils from carpets or upholstery as well as of odors. In addition, the compositions according to the present invention may be used to hygienise or disinfect carpets and exterminate micro-insects from the carpet or upholstery.

EXAMPLES

The following examples will illustrate the present invention. The compositions are made by combining the listed ingredients in the listed proportions (weight % unless otherwise specified).

| Compositions (weight %) | I | II | III | IV | V | VI | VII | VIII |
|---|---|---|---|---|---|---|---|---|
| Hydrogen peroxide | 6.0 | 6.0 | 6.0 | 7.0 | 6.0 | 7.0 | 6.0 | 7.0 |
| Na CnAS | 1.0 | 1.0 | — | — | 1.0 | — | 1.0 | 1.0 |
| MA/AA | 1.0 | 1.0 | — | — | 1.0 | — | 1.0 | 1.0 |
| DETPMP | 0.2 | 0.2 | — | — | 0.2 | — | 0.2 | — |
| EDDS | — | — | — | — | — | — | — | 0.2 |
| PA | — | — | 1.0 | 1.0 | — | 1.0 | — | — |
| C8 amine oxide | 1.0 | 1.0 | 2.0 | 2.0 | — | — | — | — |
| C14 amine oxide | 1.0 | 1.0 | 1.0 | 1.0 | — | — | — | — |
| C10 amine oxide | 1.0 | 1.0 | — | — | — | — | — | — |
| Pyrocatechol | — | 0.05 | — | 0.01 | — | — | — | — |
| HPNO | — | — | — | — | 0.5 | — | — | 0.5 |
| Salicylic acid | 0.1 | 0.1 | 0.1 | 0.1 | 0.1 | 0.1 | 0.1 | 0.1 |
| Water | | | | Balance | | | | |
| Sulphuric acid up to pH | 5 | 5 | 6 | 6 | 6 | 6 | 6 | 7 |

Na CnAS is sodium alkyl sulphate. DETPMP is diethylene triamine penta methylene phosphonic acid available from Monsanto under the trade name Dequest 2060 or Dequest 4060. MA/AA is copolymer of maleic/acrylic acid, average molecular weight about 70,000. PA is an ethoxylated tetraethylenepentamine, average molecular weight about 70,000. EDDS is trisodium salt solution of [S,S]-Ethylenediamine-N,N'-disuccinic Acid. HPNO is 2-hydroxy pyridine N-oxide.

The compositions in the examples above are suitable for the cleaning of carpets according to the present invention, i.e. they exhibit excellent particulate soil and greasy/oily soil removing performance while providing also excellent stain removal performance on other types of soils such as bleachable stains like coffee, beverages and the like.

These compositions are suitable to be used in manual carpet cleaning applications, neat or diluted, as well as in carpet cleaning machines.

What is claimed is:

1. A liquid aqueous composition comprising from about 0.01% to about 0.1% by weight of the total composition of salicylic acid compound according to the following formula:

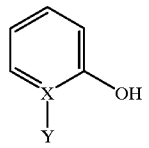

wherein X is carbon, Y is one of the following groups —CHO, —OH, or —$(CH_2)_n$—COOH and wherein n is an integer of from about 0 to about 20, and from about 0.01% to about 20% by weight of a soil suspending agent selected from the group consisting of soil suspending polycarboxylate polymers, soil suspending polyamine polymers, hydroxy-pyridine N-oxides, and mixtures thereof, and wherein there is an effective amount of bleach that is present as a source of active oxygen which is hydrogen peroxide or source thereof, and wherein the pH of said liquid composition is between 1 and 6.

2. A composition according to claim 1 wherein said salicylic acid compound is according to the following formula:

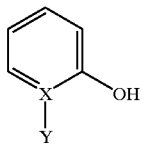

wherein X is carbon, Y is —$(CH_2)_n$—COOH and wherein n is an integer of from 0 to 10.

3. A composition according to claim 1 wherein said composition comprises about 0.01% by weight of the total composition of said salicylic acid compound.

4. A composition according to claim 3 wherein said composition comprises about 0.05% by weight of the total composition of said salicylic acid compound.

5. A composition according to claim 1 further comprising an amine oxide surfactant having the formula $R_1R_2R_3NO$ wherein $R_1$ is a saturated linear or branched alkyl group of from about 1 to about 30 carbon atoms, and wherein $R_2$ and $R_3$ are independently linear or branched alkyl groups of from about 1 to about 4 carbon atoms.

6. A composition according to claim 5 wherein said amine oxide surfactant is according to the formula $R_1R_2R_3NO$ wherein R1 is a saturated linear or branched alkyl group of from about 6 to about 20 carbon atoms, and wherein R2 and R3 are independently linear or branched alkyl groups of from about 1 to about 3 carbon atoms, or mixtures thereof.

7. A composition according to claim 1 wherein said soil suspending polyamine polymer is an ethoxylated polyethylene polyamine, or its quaternary salt.

8. A composition according to claim 1 wherein said soil suspending polycarboxylate polymer is a homo- or co-polymeric polycarboxylic acid or salt, a polyacrylate, a copolymer of maleic anhydride or acrylic acid with ethylene, methylvinyl ether or styrene, or an acrylic/maleic based copolymer.

9. A composition according to claim 1 further comprising a chelating agent selected from the group consisting of amino carboxylate chelating agents, phosphonate chelating agents, aromatic chelating agents, ethylene diamine N,N'-disuccinic acids and mixtures thereof.

10. A composition according to claim 9 wherein said chelating agent is diethylene triamine pentamethylene phosphonates, ethylene diamine N,N'-disuccinic acids, diethylene triamine pentaacetates or mixtures thereof.

11. A composition according to claim 1 wherein said composition comprises from about 0.05% to about 15% by weight of the total composition of said soil suspending polycarboxylate polymers, soil suspending polyamine polymers, hydroxy-pyridine N-oxides, or mixtures thereof.

12. A composition according to claim 1 wherein said composition comprises from about 0.1% to about 10% by weight of the total composition of said soil suspending polycarboxylate polymers, soil suspending polyamine polymers, hydroxy-pyridine N-oxides, or mixtures thereof.

13. A composition according to claim 1 wherein said composition comprises from about 0.1% to about 15% by weight of active oxygen in said composition.

14. A composition according to claim 13 wherein said composition comprises from about 0.5% to about 10% by weight of active oxygen in said composition.

15. A composition according to claim 1 which further comprises from 0.1% to 50% of a surfactant selected from the group consisting of ethoxylated $C_6$–$C_{24}$ fatty alcohol nonionic surfactants, amine oxides of the formula $R_1R_2R_3NO$, wherein each $R_1$, $R_2$ and $R_3$ is independently a linear or branched alkyl group of 1 to 30 carbon atoms, alkyl propoxylates, fatty acid $C_6$–$C_{24}$ alkanolamides, $C_6$–$C_{20}$ polyethyleneglycol ethers, polyethyleneglycol of molecular weight 1000 to 80,000 and mixtures thereof.

* * * * *